US011091350B2

(12) United States Patent
Blanchard

(10) Patent No.: US 11,091,350 B2
(45) Date of Patent: Aug. 17, 2021

(54) AUDIO ORIENTATION SYSTEMS FOR ELEVATOR CARS

(71) Applicant: Otis Elevator Company, Farmington, CT (US)

(72) Inventor: Arnaud Blanchard, Région Centre (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 634 days.

(21) Appl. No.: 15/955,861

(22) Filed: Apr. 18, 2018

(65) Prior Publication Data

US 2018/0312369 A1 Nov. 1, 2018

(30) Foreign Application Priority Data

Apr. 28, 2017 (EP) ..... 17305478

(51) Int. Cl.
*B66B 3/00* (2006.01)

(52) U.S. Cl.
CPC ..... *B66B 3/002* (2013.01); *B66B 3/006* (2013.01)

(58) Field of Classification Search
CPC ..... B66B 3/00; B66B 3/002; B66B 3/006; B66B 1/3415; B66B 1/468; B66B 2201/4615; B66B 2201/4646; B66B 5/0012; B66B 2201/103; B66B 5/0018; B66B 13/26; B66B 3/02; B66B 2201/104; B66B 5/0037; B66B 1/3423; B66B 5/00; B66B 13/02; B66B 13/14; B66B 13/30
See application file for complete search history.

(56) References Cited

U.S. PATENT DOCUMENTS 2,009,701 A 7/1935 Miles
2,991,448 A 7/1961 Diamond et al.
4,032,882 A * 6/1977 Mandel ..... B66B 3/023 187/398
4,400,786 A 8/1983 Mandel et al.
4,482,032 A * 11/1984 Enriquez ..... B66B 1/468 187/392

(Continued)

FOREIGN PATENT DOCUMENTS

CN 1656004 A 8/2005
CN 102364652 2/2012

(Continued)

OTHER PUBLICATIONS

European Search Report, European Application No. 17305478.4, dated Oct. 13, 2017, European Patent Office; European Search Report 8 pages.

*Primary Examiner* — Marlon T Fletcher
(74) *Attorney, Agent, or Firm* — Cantor Colburn LLP

(57) ABSTRACT

Elevator systems having an elevator car having a first elevator car door and an audio orientation system. The audio orientation system includes an audio system controller, at least one first speaker positioned proximate the first elevator car door, and at least one second speaker positioned in the elevator car opposite the first elevator car door. When the first elevator car door opens, the audio system controller controls the at least one first speaker and the at least one second speaker such that an audio orientation output is generated at at least one of the speakers to indicate that the first elevator car door is open.

14 Claims, 7 Drawing Sheets

(56) References Cited

U.S. PATENT DOCUMENTS

| | | | | |
|---|---|---|---|---|
| 4,491,199 | A * | 1/1985 | Shea | B66B 13/143 187/316 |
| 5,004,076 | A | 4/1991 | Chen et al. | |
| 5,284,444 | A | 2/1994 | Raynes | |
| 5,551,533 | A * | 9/1996 | Ng | B66B 3/00 187/390 |
| 2002/0063632 | A1* | 5/2002 | Bowman | G08B 25/007 340/4.1 |
| 2002/0121984 | A1* | 9/2002 | Tsukamoto | B66B 1/462 340/692 |
| 2005/0099291 | A1 | 5/2005 | Landau | |
| 2011/0172907 | A1 | 7/2011 | Freitas | |
| 2014/0299421 | A1 | 10/2014 | Hanvey et al. | |
| 2018/0312369 | A1* | 11/2018 | Blanchard | B66B 3/006 |
| 2019/0071280 | A1* | 3/2019 | Marvin | B66B 3/002 |
| 2019/0177121 | A1* | 6/2019 | Shah | B66B 3/002 |
| 2019/0248623 | A1* | 8/2019 | Yoshizawa | B66B 3/00 |

FOREIGN PATENT DOCUMENTS

| | | | |
|---|---|---|---|
| EP | 2214425 | | 8/2010 |
| EP | 2327062 | B1 | 12/2013 |
| JP | 52093045 | | 8/1977 |
| JP | 54047262 | | 4/1979 |
| JP | S6023272 | A | 2/1985 |
| JP | 07206290 | | 8/1995 |
| JP | 2006008278 | A | 1/2006 |
| JP | 2007119101 | A | 5/2007 |
| JP | 2007230742 | | 9/2007 |
| JP | 2009091116 | | 4/2009 |
| WO | 20160146357 | | 9/2016 |

* cited by examiner

AUDIO ORIENTATION SYSTEMS FOR ELEVATOR CARS

CROSS-REFERENCE TO RELATED APPLICATIONS

This application claims the benefit of European Application No. 17305478.4, filed Apr. 28, 2017, which is incorporated herein by reference in its entirety.

BACKGROUND

The subject matter disclosed herein generally relates to elevator cars and, more particularly, audio orientation systems for elevator cars and loading/unloading of elevator cars.

Entering and exiting elevator cars can be difficult for persons with disabilities, such as being sight impaired, or for persons carrying large objects. Such persons may enter an elevator car and upon arriving at a landing may not know which elevator car door opens so that they can exit (e.g., an elevator car with front and rear elevator car doors). Thus, when the elevator car doors open at a landing (e.g., the passenger's destination floor), the passenger may not be able to tell which direction they should walk to exit the elevator car. It may be advantageous to provide improved mechanisms for such passengers to obtain the information they require for entering or exiting an elevator car.

SUMMARY

According to some embodiments, elevator systems are provided. The elevator systems includes an elevator car having a first elevator car door and an audio orientation system. The audio orientation system includes an audio system controller, at least one first speaker positioned proximate the first elevator car door, and at least one second speaker positioned in the elevator car opposite the first elevator car door. When the first elevator car door opens, the audio system controller controls the at least one first speaker and the at least one second speaker such that an audio orientation output is generated at at least one of the speakers to indicate that the first elevator car door is open.

In addition to one or more of the features described herein, or as an alternative, further embodiments of the elevator systems may include that, when a request is made at a landing of the elevator system and when the first elevator car door opens, the audio system controller controls the at least one second speaker to generate an audio orientation output indicating that the first elevator car door is open.

In addition to one or more of the features described herein, or as an alternative, further embodiments of the elevator systems may include that, when a request is made within the elevator car to travel to a landing of the elevator system and when the first elevator car door opens, the audio system controller controls the at least one first speaker to generate an audio orientation output indicating that the first elevator car door is open.

In addition to one or more of the features described herein, or as an alternative, further embodiments of the elevator systems may include that the elevator car comprises a second elevator car door opposite the first elevator door and wherein the at least one second speaker is positioned proximate the second elevator car door.

In addition to one or more of the features described herein, or as an alternative, further embodiments of the elevator systems may include that, when the second elevator car door opens, the audio system controller controls the at least one first speaker and the at least one second speaker such that an audio orientation output is generated at at least one of the speakers to indicate that the second elevator car door is open.

In addition to one or more of the features described herein, or as an alternative, further embodiments of the elevator systems may include that, when a request is made at a landing of the elevator system and when the second elevator car door opens, the audio system controller controls the at least one first speaker to generate an audio orientation output indicating that the second elevator car door is open.

In addition to one or more of the features described herein, or as an alternative, further embodiments of the elevator systems may include that, when a request is made within the elevator car to travel to a landing of the elevator system and when the second elevator car door opens, the audio system controller controls the at least one second speaker to generate an audio orientation output indicating that the second elevator car door is open.

In addition to one or more of the features described herein, or as an alternative, further embodiments of the elevator systems may include that the audio orientation system comprises four speakers and the elevator comprises four corners, wherein a speaker is positioned in each of the corners.

In addition to one or more of the features described herein, or as an alternative, further embodiments of the elevator systems may include at least one detector arranged to detect the presence of a sight impaired user, the at least one detector in communication with the audio orientation system such that the audio orientation system is activated when the detector detects the presence of the sigh impaired user.

According to some embodiments, methods of operating elevator systems are provided. The elevator systems include an elevator car having a first elevator car door, an audio system controller, at least one first speaker positioned adjacent the first elevator car door, and at least one second speaker positioned in the elevator car opposite the first elevator car door. The methods include detecting an opening of the first elevator car door at a landing of an elevator system, and generating an audio orientation output from at least one of the first speakers or second speakers, wherein the audio orientation output indicates the opening of the first elevator car door.

In addition to one or more of the features described herein, or as an alternative, further embodiments of the methods may include detecting a request made at a landing of the elevator system, wherein the audio orientation output is generated at the at least one second speaker and indicates that the first elevator car door is open.

In addition to one or more of the features described herein, or as an alternative, further embodiments of the methods may include detecting a request made at a car operating panel within the elevator car, wherein the audio orientation output is generated at the at least one first speaker and indicates that the first elevator car door is open.

In addition to one or more of the features described herein, or as an alternative, further embodiments of the methods may include that the elevator car includes a second elevator car door opposite the first elevator car door and the at least one second speaker is positioned adjacent the second elevator car door, the method further includes detecting a request made at a landing of the elevator system, wherein the audio orientation output is generated at the at least one first speaker and indicates that the second elevator car door is open.

In addition to one or more of the features described herein, or as an alternative, further embodiments of the methods may include that the elevator car includes a second elevator car door opposite the first elevator car door and the at least one second speaker is positioned adjacent the second elevator car door, the method further includes detecting a request made at a car operating panel within the elevator car, wherein the audio orientation output is generated at the at least one second speaker and indicates that the second elevator car door is open.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
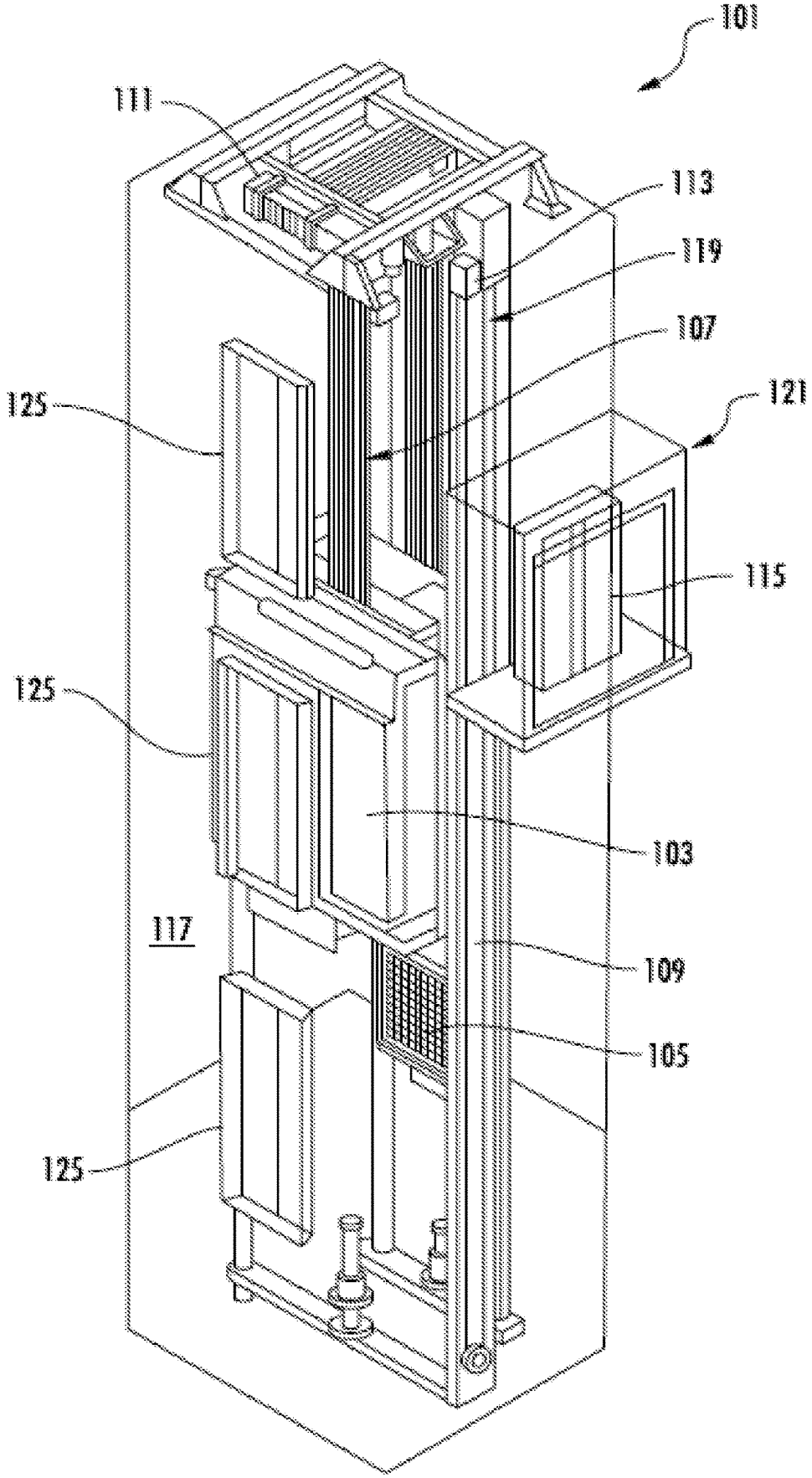
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101, such as inside a landing cabinet located at a landing.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes. For example, ropeless elevator systems, hydraulic elevator systems, etc. may incorporate embodiments of the present disclosure.

Figure 2A:
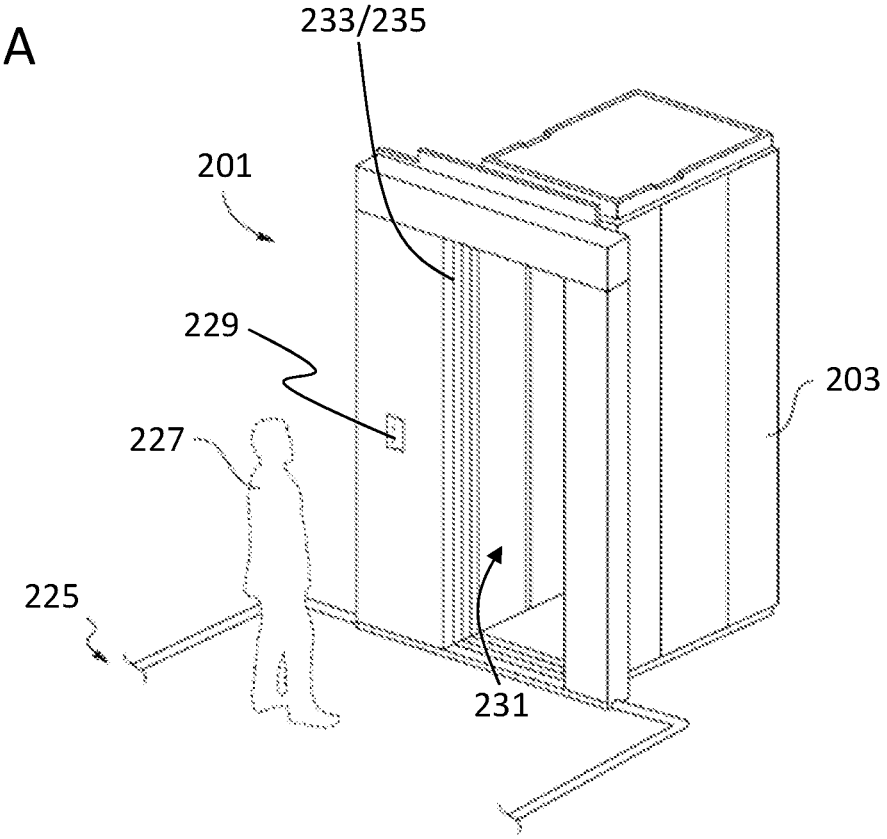
FIG. 2A is a schematic illustration of a landing floor of an elevator system with a hall call panel that may employ various embodiments of the present disclosure.
Figure 2B:
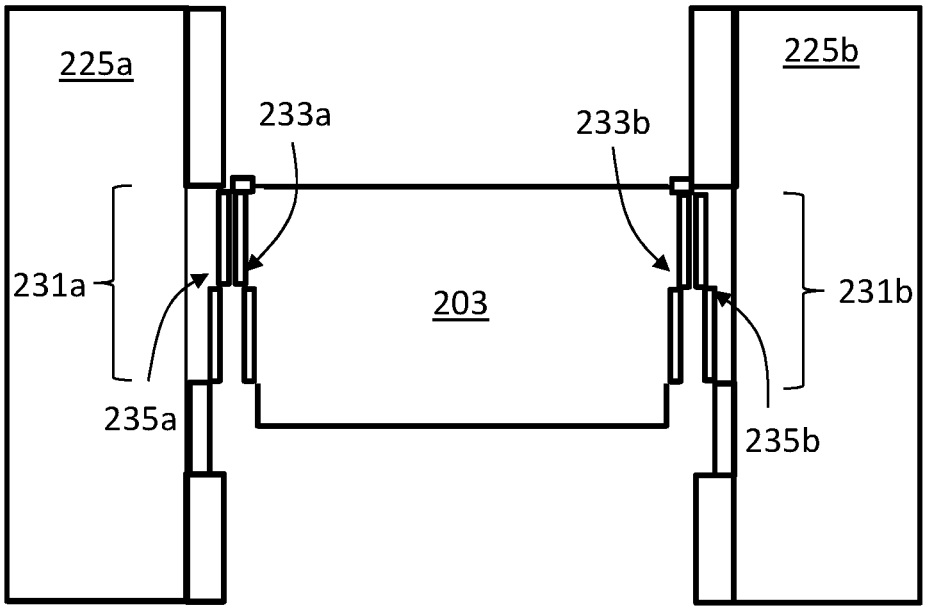
FIG. 2B is a plan view illustration of the elevator system of FIG. 2A illustrating first and second side landings and entrances.

FIG. 2A is a schematic illustration of an elevator system 201 that may incorporate embodiments disclosed herein, and FIG. 2B is a top-down view illustrating front and rear doors on an elevator car 203 and at a landing 225. As shown in FIG. 2A, an elevator car 203 is located at a landing 225. The elevator car 203 may be called to the landing 225 by a passenger 227 that desires to travel to another floor within a building using a hall call panel 229. The passenger 227 can enter or exit the elevator car 203 through an entrance 231 which has landing door 233 and elevator car doors 235 that operate in tandem when at the landing 225. Those of skill in the art will appreciate that in some configurations, the elevator car 203 can include elevator car doors 235 at two entrances, typically opposite each other, to enable "front" and "rear" loading/unloading from the elevator car 203, depending on the location of a landing door 235 and the configuration of the particular landing.

For example, FIG. 2B illustrates a top down view of the elevator car 203 of FIG. 2A at the landing 225. However, as shown, the landing 225 has a first side 225*a* (e.g., front side) and a second side 225*b* (e.g., rear side). When the elevator car 203 is located at the landing 225, a first elevator car door 233*a* is positioned adjacent a first landing door 235*a* at the first side 225*a* of the landing 225, and when opened form a first entrance 231*a*. Similarly, a second elevator car door 233*b* is positioned adjacent a second landing door 235*b* at the second side 225*b* of the landing 225, and when opened form a second entrance 231*b*.

Blind or otherwise sight-impaired persons may have difficultlies using elevators, particularly elevators having two separate entrances. One such difficulty may arise due to the possibility that the elevator car doors that open at a landing may be located on a different side of the elevator car than the side at which the sight-impaired person entered the elevator car. Various solutions have been provided, including audible buttons within the elevator car and/or at the landing, a voice synthesizer emitting instructions from a car operating panel, and/or a voice synthesizer emitting instructions from a panel or display at a landing. However, such solutions may still elicit confusion in sight-impaired persons. Accordingly, embodiments provided herein are directed to improved systems for audio orientation within elevator systems.

Figure 3:
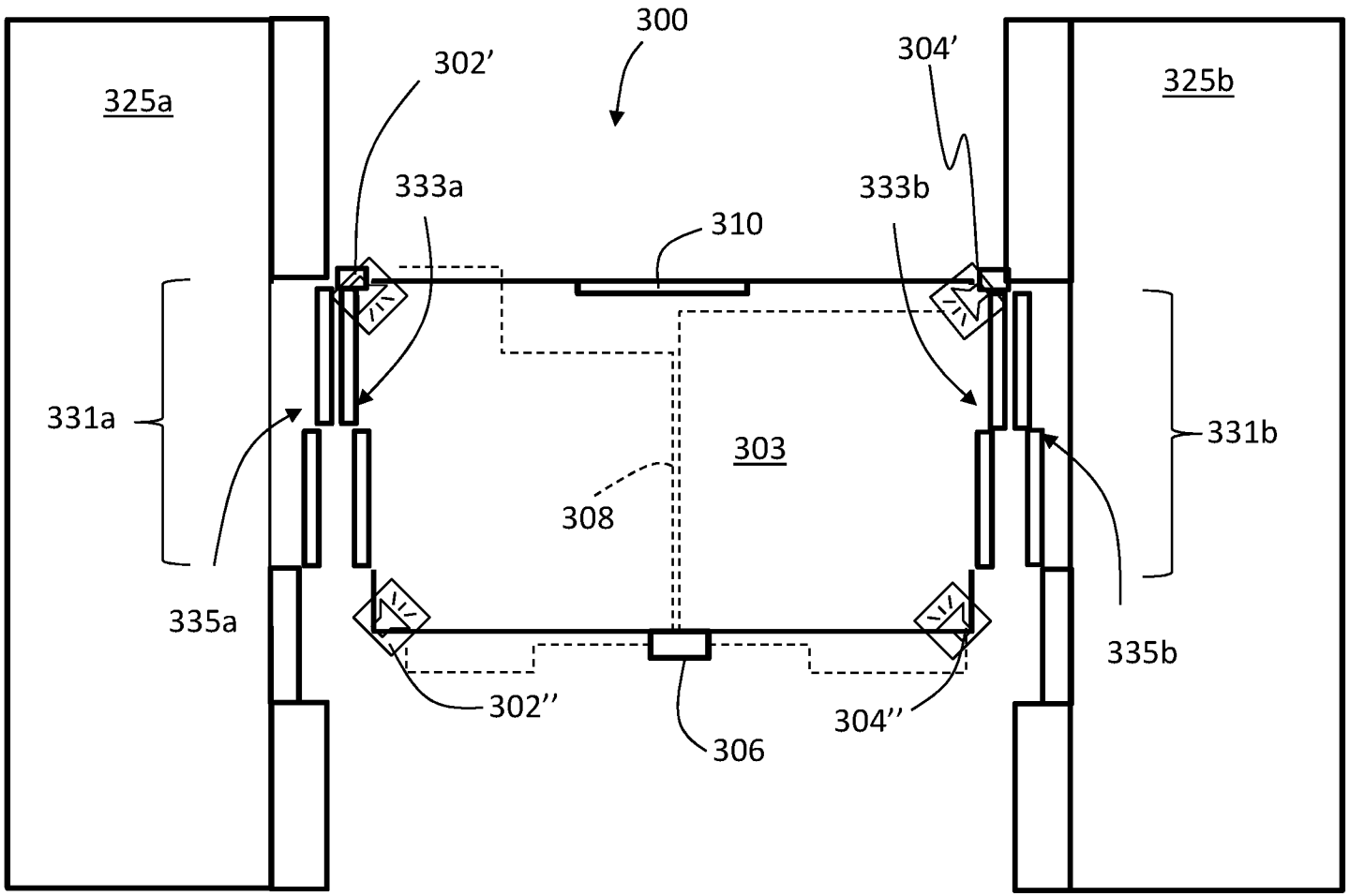
FIG. 3 is a schematic illustration of an elevator car having an audio orientation system installed in accordance with an embodiment of the present disclosure.

Turning now to FIG. 3, a schematic illustration of an elevator car 303 having an audio orientation system 300 installed therein is shown. As shown, the elevator car 303 has first and second elevator car doors 333*a*, 333*b* at first and second sides which align with first and second landing doors 335*a*, 335*b* at a landing 325 (indicated as first side 325*a* and second side 325*b*). The first elevator car doors 333*a* and the first landing doors 335*a* define a first entrance 331*a* at the first side 325*a* of the landing 325. Similarly, the second elevator car doors 333*ba* and the second landing doors 335*b* define a second entrance 331*b* at the second side 325*b* of the landing 325. The audio orientation system 300 includes a plurality of speakers 302', 302", 304', 304" installed in corners of the elevator car 303.

The audio orientation system 300 includes first speakers 302', 302" located proximate the first elevator car door 333*a*. Proximate the second elevator car door 333*b*, the audio orientation system 300 includes second speakers 304', 304". The speakers 302', 302", 304', 304" are arranged to generate audio orientation output to provide personalized voice indications or auditory instructions and/or sounds to safely guide and orient a sight-impaired passenger relative to which entrance 331*a*, 331*b* will be open for loading and unloading. Although shown with an elevator car 303 having first and second elevator doors 333*a*, 333*b* (e.g., two entrance elevator car) those of skill in the art will appreciate that embodiments described herein can be employed in elevator cars that have any number of entrances, including single entrance elevator cars.

The audio orientation system 300 includes an audio system controller 306 that is in communication with the speakers 302', 302", 304', 304". As shown, a communication connection 308 is established between the audio system controller 306 and the speakers 302', 302", 304', 304". The communication connection 308 may be a wired and/or wireless communication connection using any known communications protocols and/or techniques. The audio system controller 306 includes various electrical components, including, but not limited to, a processor, memory, electrical buses, communication components, etc. The audio system controller 306 controls output of the speakers 302', 302", 304', 304" in accordance with embodiments of the present disclosure.

As described herein, the audio system controller 306 is configured to control which of the speakers 302', 302", 304', 304" will generate an audio orientation output and further can control the specific output from the speakers 302', 302", 304', 304" (e.g., synthesized voice communications/instructions, sounds, audio indicators, etc.). As shown, the elevator 303 also includes a car operating panel 310 which includes various electronic components as will be appreciated by those of skill in the art. In some embodiments, the audio system controller 306 can be integrated into the car operating panel 310 or may be integrated and/or part of other electronics and/or control systems associated with the elevator car 303 or corresponding elevator system. In other embodiments, the audio system controller 306 can be mounted onto an exterior of the elevator car 303 as a discrete device.

The audio system controller 306 is configured to control the speakers 302', 302", 304', 304" to provide audio indications regarding which elevator car doors will open at a landing and/or provide other audio indicator as described herein. In some embodiments, the speakers 302', 302", 304', 304" may be installed outside of the elevator car 303, and fixed in a corner of a back panel and/or anywhere on elevator car side panels and/or framing. When installed behind elevator car paneling, holes or other features may be provided within the panels to enable sound to be heard by passengers within the elevator car 303 and/or located on the landing 325.

Figure 4B:
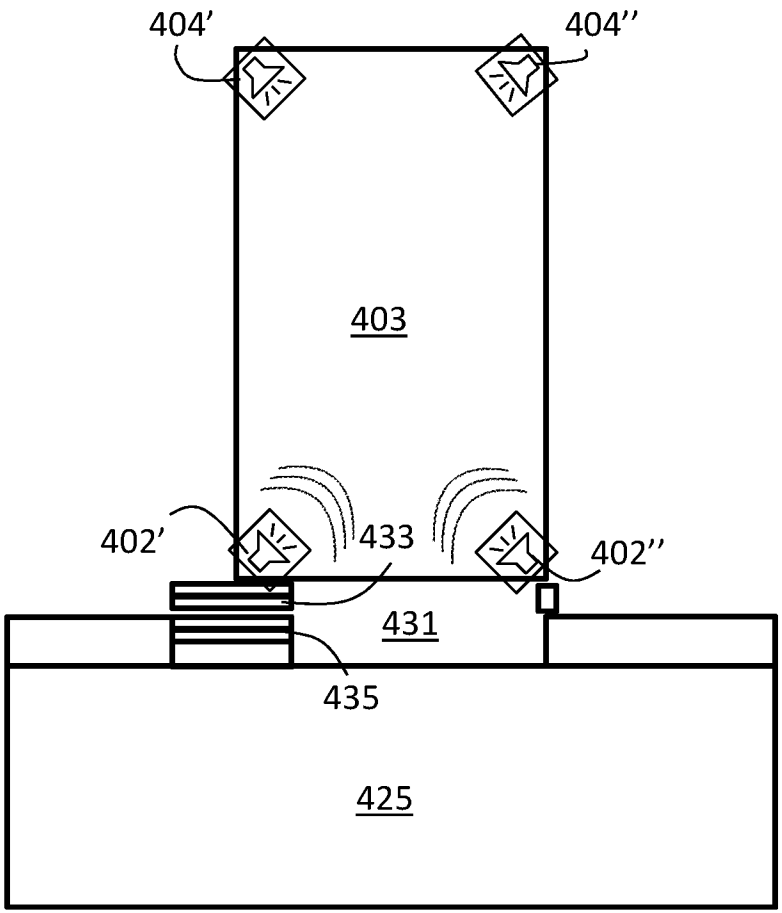
FIG. 4B is a schematic illustration of an elevator system having an audio orientation system performing an unloading operation in accordance with an embodiment of the present disclosure.
Figure 4A:
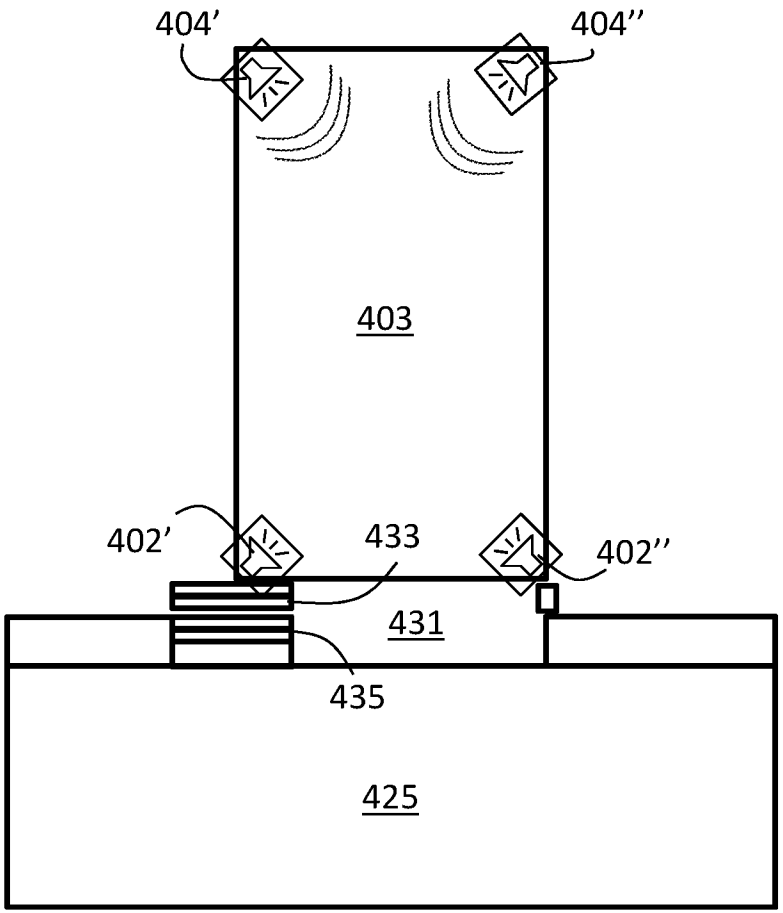
FIG. 4A is a schematic illustration of an elevator system having an audio orientation system performing a loading operation in accordance with an embodiment of the present disclosure.

Turning now to FIGS. 4A-4B, schematic illustrations of an audio orientation system in accordance with an embodiment of the present disclosure are shown. FIG. 4A illustrates an elevator car 403 located at a landing 425 indicating operation of the audio orientation system to help sight impaired passengers with entering or loading on to the elevator car 403. FIG. 4B illustrates the audio orientation system operating to help sight impaired passengers with exiting or unloading from the elevator car 403 on to the landing 425.

The audio orientation system includes four speakers 402', 402", 404', 404" located at corners of the elevator car 403. As shown, two first speakers 402', 402" are positioned adjacent an elevator car door 433 and two second speakers 404', 404" are located at an opposite side of the elevator car 403 (e.g., away and/or opposite from the elevator car door 403. As such, the first speakers 402', 402" may be referred to as "front speakers" and the second speakers 404', 404" may be referred to as "rear speakers." When the elevator car 403 reaches the landing 425, the elevator car doors 433 will align with landing doors 435 to open an entrance 431 to enable passengers to load and/or unload from the elevator car 403.

As shown in FIG. 4A, a loading operation of the audio orientation system is schematically shown. Such loading operation may be performed when a person that is sight impaired has called the elevator car 403 from the landing 403 (e.g., a desire to ride the elevator car 403 to another floor within a building; request made at the landing 425 such as at a hall call button). When the entrance 431 is opened, the second speakers 404', 404" will be operated (e.g., controlled by an audio system controller) to generate audio orientation output including instructions, sounds, or other audio indicators to aid the sight impaired person in entering the elevator car 403. As shown, in the loading operation (FIG.

4A), the first speakers 402', 402" are not operated and do not generate any audio orientation output. As such, a clear and easily understood audio indicator can be generated by the audio orientation system to aid sight impaired persons with loading onto the elevator car 403. In one non-limiting example, the second speakers 404', 404" can output an audio prompt that states "car doors are open." Further, in some embodiments, the second speakers 404', 404" can output an audio prompt that can include timing information, such as a countdown related to when the entrance 431 will be closed.

As shown in FIG. 4B, an unloading operation of the audio orientation system is schematically shown. Such unloading operation may be performed when a person that is sight impaired has requested the elevator car 403 to travel to the landing 403 (e.g., a desire to reach a specific floor destination; request made within the elevator car 403, such as at a car operating panel). When the entrance 431 is opened, the first speakers 402', 402" will be operated (e.g., controlled by an audio system controller) to generate audio orientation output including instructions, sounds, or other audio indicators to aid the sight impaired person in exiting the elevator car 403. As shown, in the unloading operation (FIG. 4B), the second speakers 404', 404" are not operated and do not generate any audio orientation output. As such, a clear and easily understood audio indicator can be generated by the audio orientation system to aid sight impaired persons with unloading from the elevator car 403. In one non-limiting example, the first speakers 402', 402" can output an audio prompt that states "car doors are open." Further, in some embodiments, the first speakers 402', 402" can output an audio prompt that can include timing information, such as a countdown related to when the entrance 431 will be closed.

Figure 5:
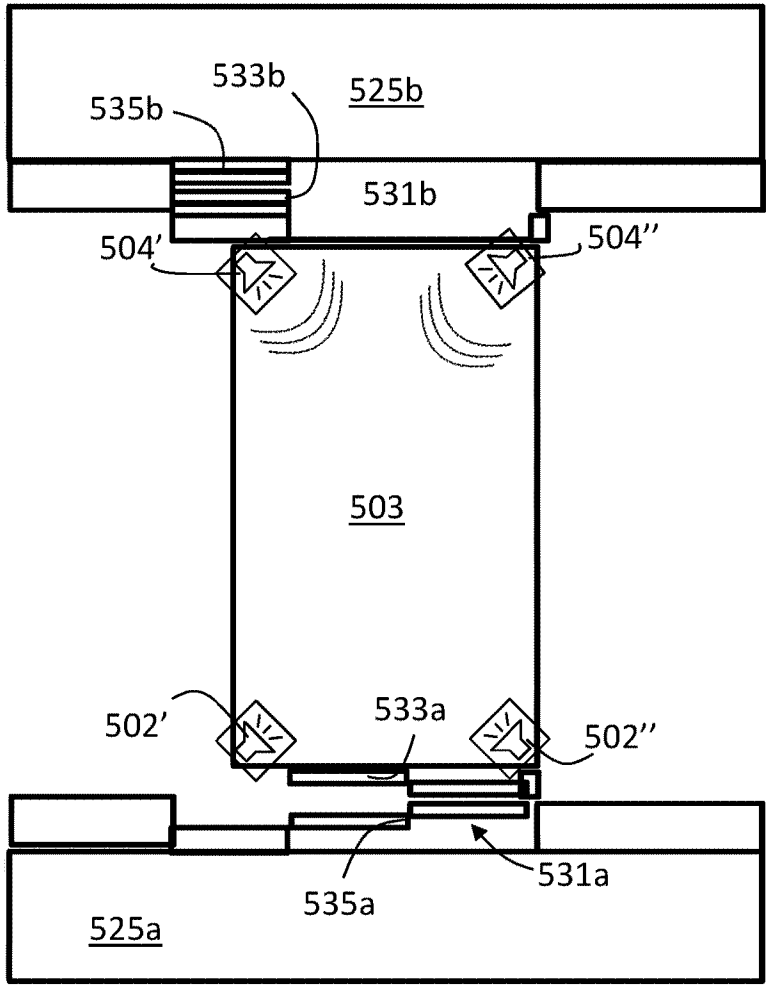
FIG. 5 is a schematic illustration of an elevator system having an audio orientation system installed in accordance with an embodiment of the present disclosure.

Turning now to FIG. 5, a schematic illustration of an audio orientation system installed within a double-entrance elevator system in accordance with an embodiment of the present disclosure is shown. As shown, an elevator car 503 includes first elevator car doors 533*a* and second elevator car doors 533*b* on opposite sides of the elevator car 503. Further, as shown, a landing has a first side 525*a* and a second side 525*b* that are able to be accessed by the first and second elevator car doors 533*a*, 533*b*. When the elevator car 503 is located at the landing, the first elevator car doors 533*a* align with first side landing doors 535*a* to define a first entrance 531*a* and the second elevator car doors 533*b* align with second side landing doors 535*b* to define a second entrance 531*b*.

The audio orientation system is configured to aid both loading and unloading from either entrance 531*a*, 531*b*. To enable such assistance, the audio orientation system includes four speakers 502', 502", 504', 504" located at corners of the elevator car 503. As shown, two first speakers 502', 502" are positioned adjacent the first elevator car door 533*a* and two second speakers 504', 504" are positioned adjacent the second elevator car door 533*a*. Similar to the operation described above with respect to FIGS. 4A-4B, in a loading operation from the first side 525*a* of the landing, the second speakers 504', 504" will be operated indicating the first entrance 531*a* is open, and the first speakers 502', 502" will not be operated. An unloading operation for the first side 525*a* of the landing through the first entrance 531*a* will operate the first 502', 502", and the second speakers 504', 504" will not be operated. An unloading operation for the second entrance 531*b* is shown schematically in FIG. 5, indicating audio orientation output generated at the second speakers 504', 504", with the second entrance 531*b* open. In a loading operation from the second side 525*b* of the landing, the first speakers 502', 502" will be operated and the second speakers 504', 504" will not be operated.

Figure 6:
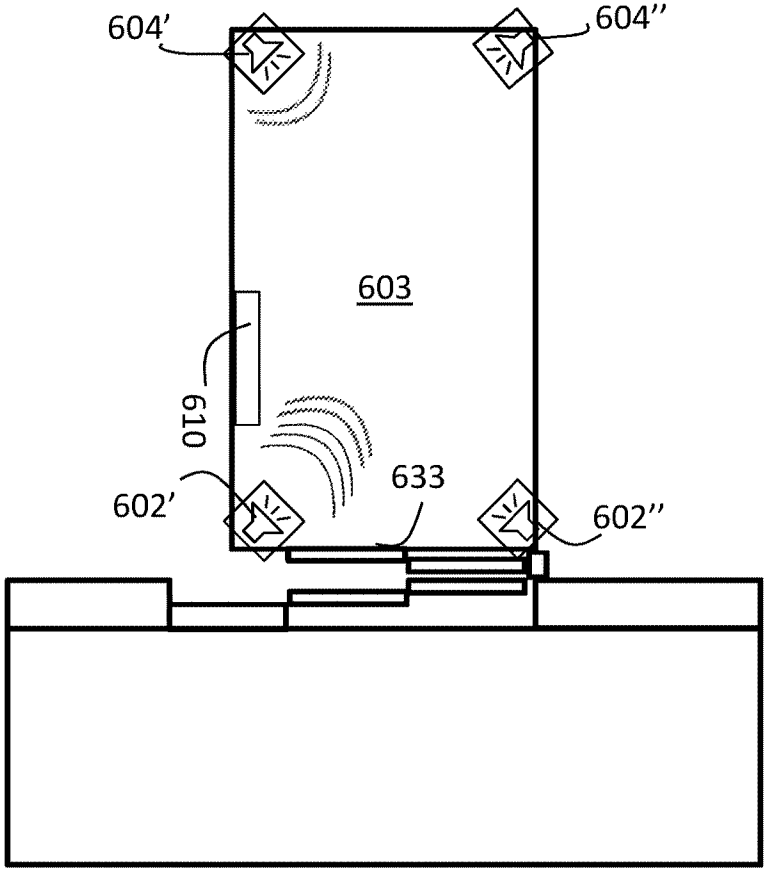
FIG. 6 is a schematic illustration of an audio orientation system in accordance with an embodiment of the present disclosure illustrating a car operating panel orientation operation.

Turning now to FIG. 6, another operation of an audio orientation system installed on an elevator car 603 is schematically illustrated. In the embodiment of FIG. 6, rather than indicating an open entrance to the elevator car 603, the audio orientation system is shown providing orientation information related to a car operating panel 610. That is, in the operating panel orientation operation, speakers that are positioned relative to the car operating panel 610 are operated and all other speakers are not operated. Similar to the above shown and described arrangements, the audio orientation system is configured with four speakers 602', 602", 604', 604" located at corners of the elevator car 603.

As shown, first speakers 602', 602" are located proximate an elevator car door 633 and second speakers 604', 604" are positioned opposite therefrom. In the present orientation operation, only those speakers that are proximate the car operating panel 610 are controlled to generate audio orientation output, e.g., one first speaker 602' and one second speaker 604'. As illustratively shown, the car operating panel 610 is located closer to one speaker (i.e., speaker 602') than the other speaker (i.e., speaker 604'), and, as such, a greater volume may be generated from the closer speaker (i.e., speaker 602') than the farther speaker (i.e., speaker 604'). As such, a directional auditory instruction can be generated to most accurately and effectively assist passengers with sight impairments. Although shown with the car operating panel 610 located on a side wall that does not include the elevator car door 633, those of skill in the art will appreciate that in some arrangements, the car operating panel will be located next to the elevator car door. In such arrangements, the audio orientation system may operate only a single speaker in the corner that has the car operating panel.

Although shown and described herein with a limited number of examples, such examples are not to be limiting. For example, various arrangements of speakers, controllers, elevator car doors, etc. can be present in a given elevator system that can still employ embodiments of the present disclosure. Further, although shown and described with respect to an audio orientation system having four speakers, those of skill in the art will appreciate that embodiments of the present disclosure are not so limited. For example, additional speakers can be provided at alternative locations (e.g., at a car operating panel, at a landing floor panel, etc.). Further, although shown and described as a single speaker in each corner, in some embodiments, multiple speakers can be arranged at the locations indicated to provide a desired audio and/or acoustic sound within the elevator car.

Figure 7:
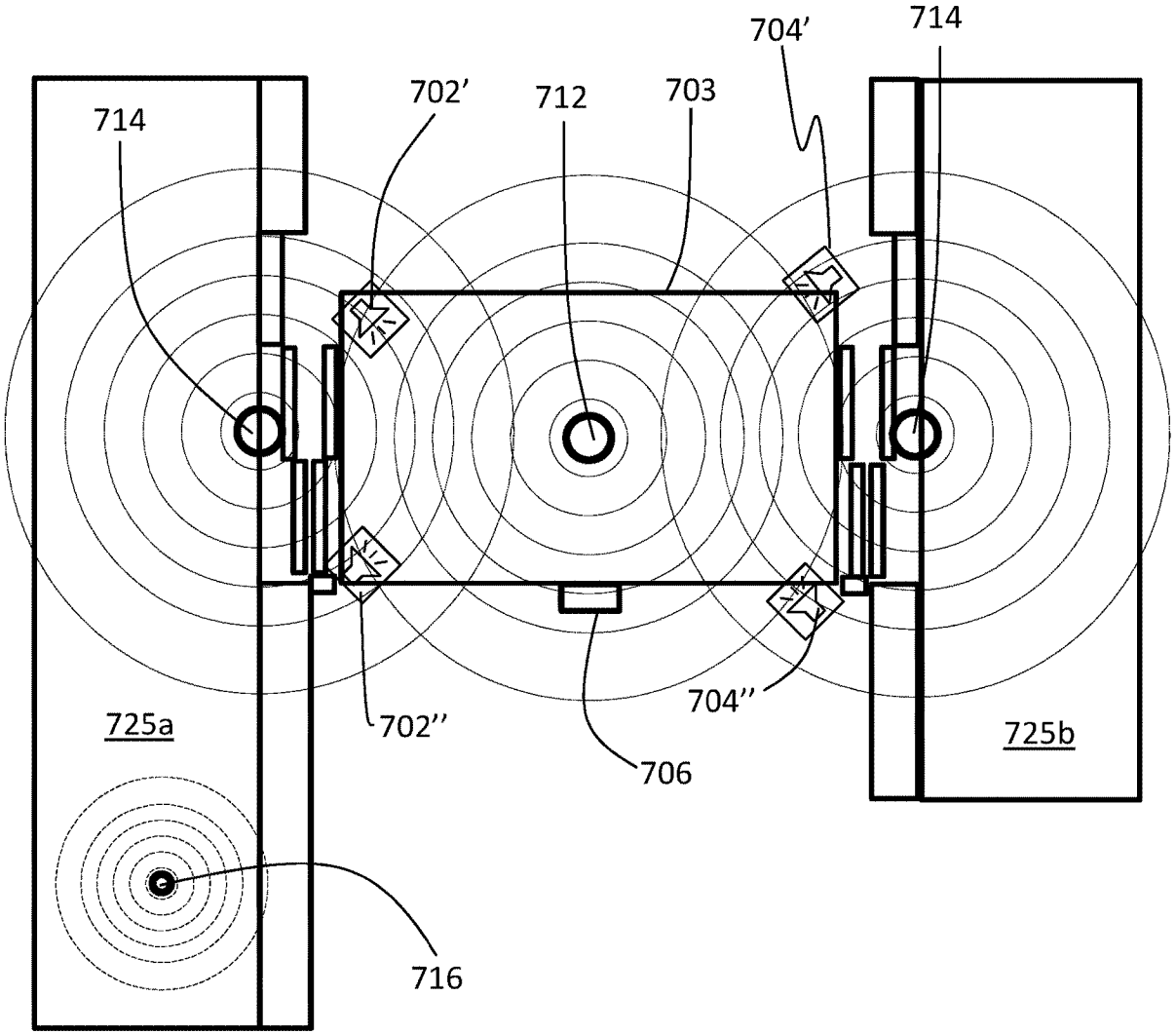
FIG. 7 is a schematic illustration of an elevator system having an audio orientation system and a detection system in accordance with an embodiment of the present disclosure.

Turning now to FIG. 7, a schematic illustration of an audio orientation system in accordance with an embodiment of the present disclosure is shown. As shown, an elevator car 703 is part of a double-entrance elevator system with a first side 725*a* and a second side 725*b* of a landing accessible form the elevator car 703. The elevator car 703 is installed with an audio orientation system similar to the systems shown and described above, having speakers 702', 702", 704', 704" arranged in corners of the elevator car 703. The system shown in FIG. 7 further includes a detection subsystem that can enable the audio orientation system to automatically function based on detected persons or detected devices, as described herein. For example, as shown, the elevator car 703 is installed with a first detector 712 and each of the sides 725*a*, 725*b* of the landing have second detectors 714. Each of the detectors 712, 714 is in operable communication with an audio system controller 706, the audio system controller 706 in communication with the speakers 702', 702", 704', 704" to control generation of audio signals to aid sight impaired users with riding within the elevator car 703.

The detectors 712, 714, in some embodiments can be proximity detectors, motion detectors, etc. that are configured to detect the presence of a user device 716. The user device 716 can be a device that is carried by a sight impaired person, such as a smartphone, RFID device, Bluetooth enabled device, etc. that can be detected by the detectors 712, 714. The user device 716 can be implemented in any type of item that may be carried or used by a passenger, such as, but not limited to, wheelchairs, walking sticks, etc. When the detectors 712, 714 detect a user device 716 in proximity, a communication signal can be sent to the audio system controller 706 to enable the system. That is, in some embodiments, the audio orientation output (e.g., prompts) that are generated by audio orientation systems of the present disclosure may only be used when a passenger having the user device 716 is in proximity to the system. In some embodiments, the user device 716 can be arranged to transmit information to the detectors 712, 714 which in turn can convey information to the audio system controller 706. For example, information may include a personal profile (e.g., a preset elevator request, such as a floor upon which the user lives) and/or disability characteristics.

However, in other embodiments, the audio orientation systems described herein may be "always on," thus providing audio orientation prompts at all times (e.g., when the elevator car doors are opened). Further, although described with using a proximity system, in some embodiments the detectors 712, 714 may be optical and/or video sensors/devices that are arranged to perform image analysis to determine when the audio orientation systems of the present disclosure are to be activated and employed.

Further, although described with the embodiments having certain speakers operated and other not operated, such control is not to be limiting. For example, in some arrangements, in any given mode of operation, all of the speakers or some subset of the speakers of the audio orientation system may be used to generate a desired audio orientation output (e.g., auditory assistance). In such arrangements, the volume or intensity of the audio orientation output generated from one or more of the speakers can be controlled to generate a desired audio/acoustic affect within the elevator car.

Figure 8:
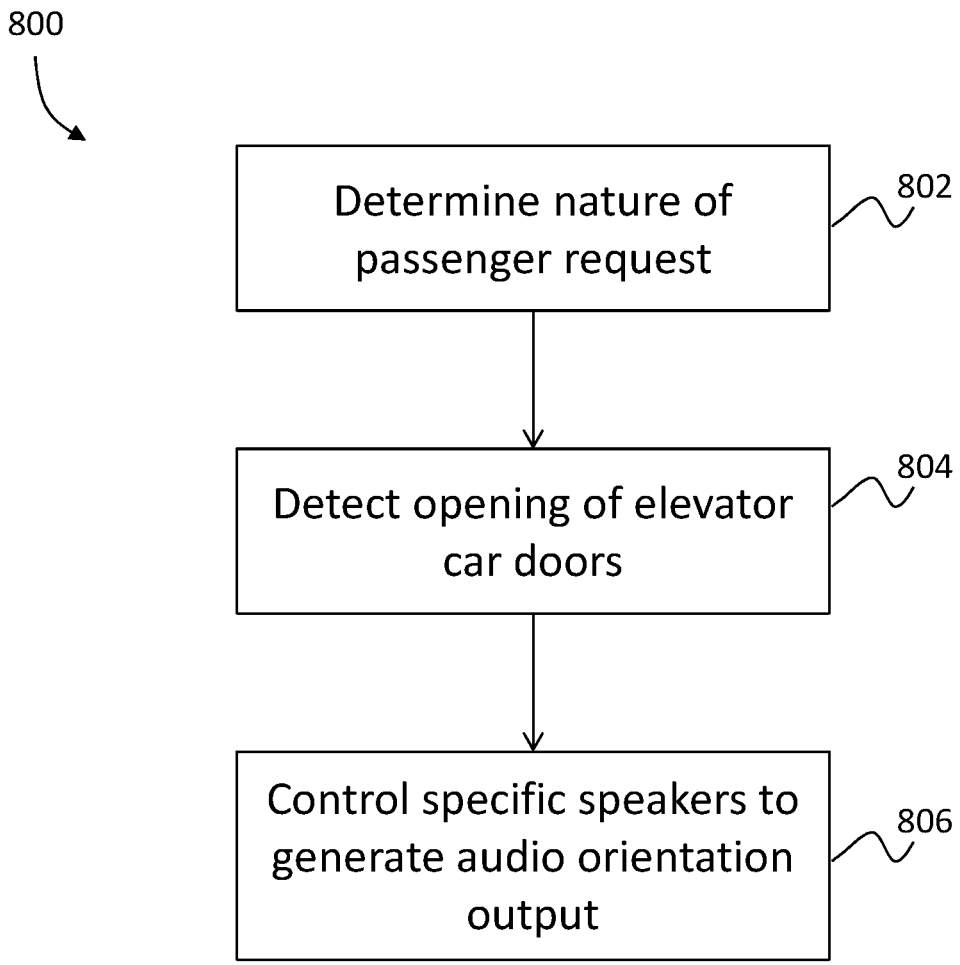
FIG. 8 is a flow process for operating an elevator system in accordance with an embodiment of the present disclosure.

Turning now to FIG. 8, a flow process 800 for operating an audio orientation system for an elevator car in accordance with an embodiment of the present disclosure is shown. The flow process 800 can be performed with a system as shown and described above. The audio orientation system includes a controller and multiple speakers arranged within an elevator car that are positioned and controllable to enable directional audio information to be generated therefrom.

At block 802, the controller receives information about movement of an elevator car based on a request from a passenger and determines the nature of the passenger request. The request can be made within an elevator car at a car operating panel, and thus indicate that a passenger within the elevator car has requested to disembark or exit at a specific landing. In such a case, the audio orientation system will be configured to perform an unloading operation. In contrast, the request can be made at a hall call panel and thus indicate that a passenger desires to enter the elevator car at a specific landing. In such a case, the audio orientation system will be configured to perform a loading operation. In some embodiments, both a loading and unloading operation may be performed, with a preference in time given to an unloading operation that is followed by a loading operation.

At block 804, the audio system controller detects the opening of the elevator car doors, which in most cases will correspond to the determination made at block 802.

At block 806, when the elevator car doors are opened, the audio system controller will control one or more of the speakers of the system to generate audio orientation output that indicates a directional orientation related to the determination made at block 802.

Although a limited number of steps are provided with respect to flow process 800, those of skill in the art will appreciate that various other steps may be employed without departing from the scope of the present disclosure. For example, in some arrangements, a detection step may be used (e.g., embodiment shown in FIG. 7) or a detection of a landing side/entrance side that will open (e.g., embodiments shown in FIG. 3 and FIG. 5). Further, added steps may include operation of the car operating panel orientation after a loading operation is performed (e.g., embodiment shown in FIG. 6). Further, rather than a determination step at block 802, the operation of the audio orientation system may be triggered by opening of the elevator car doors, and thus may not rely upon a request for a user.

Advantageously, embodiments provided herein can enable a new personalized voice indication system to safely guide sight-impaired passengers and clarify which elevator car doors are going to open or close. As described herein, speakers are positioned in corners of an elevator and are controlled to provide sounds to indicate which elevator car doors are opening or closing and/or a car operating panel location. In some embodiments, the speakers may be installed outside of the elevator car, fixed in the corner of a back panel, and/or anywhere on or to elevator car side panels. One or several holes in the car panels would allow the sound to be clearly audible in the cab.

In accordance with some embodiments, the use of the audio orientation system can be personalized and/or optimized. For example, any or all of the speakers can be operated to indicate which elevator car doors will open. Further, in some embodiments, a personalized sound or instruction could be active only on the same side as that of the opening elevator car doors. Further, various types of audio instructions or orientation indicators can be employed with embodiments of the present disclosure, including phases, statements, sounds, alerts, etc. Further, in some embodiments, the audio orientation output generated by the speakers can include informative information in addition to merely which elevator car doors are opening/opened. For example, special messages could be setup to further help passengers, including generating audio information with a time of the elevator car movements (e.g., seconds/minutes the elevator car doors will be opened, time until reaching a specific requested floor, estimated time of arrival of the elevator car at a landing, etc.).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car having a first elevator car door; and an audio orientation system, the audio orientation system comprising:

an audio system controller;

at least one first speaker positioned proximate the first elevator car door;

at least one second speaker positioned in the elevator car opposite the first elevator car door; and at least one detector arranged to detect the presence of a sight impaired user, the at least one detector in communication with the audio system controller such that the audio orientation system is activated when the at least one detector detects the presence of the sight impaired user, wherein, when the first elevator car door opens, the audio system controller controls the at least one first speaker and the at least one second speaker such that an audio orientation output is generated at at least one of the speakers to indicate that the first elevator car door is open, and wherein the at least one detector is configured to detect a user device of the sight impaired user.

2. The elevator system of claim 1, wherein, when a request is made at a landing of the elevator system and when the first elevator car door opens, the audio system controller controls the at least one second speaker to generate an audio orientation output indicating that the first elevator car door is open.

3. The elevator system of claim 1, wherein, when a request is made within the elevator car to travel to a landing of the elevator system and when the first elevator car door opens, the audio system controller controls the at least one first speaker to generate an audio orientation output indicating that the first elevator car door is open.

4. The elevator system of claim 1, wherein the elevator car comprises a second elevator car door opposite the first elevator door and wherein the at least one second speaker is positioned proximate the second elevator car door.

5. The elevator system of claim 4, wherein, when the second elevator car door opens, the audio system controller controls the at least one first speaker and the at least one second speaker such that an audio orientation output is generated at at least one of the speakers to indicate that the second elevator car door is open.

6. The elevator system of claim 5, wherein, when a request is made at a landing of the elevator system and when the second elevator car door opens, the audio system controller controls the at least one first speaker to generate an audio orientation output indicating that the second elevator car door is open.

7. The elevator system of claim 5, wherein, when a request is made within the elevator car to travel to a landing of the elevator system and when the second elevator car door opens, the audio system controller controls the at least one second speaker to generate an audio orientation output indicating that the second elevator car door is open.

8. The elevator system of claim 1, wherein the audio orientation system comprises four speakers and the elevator comprises four corners, wherein a speaker is positioned in each of the corners.

9. The elevator system of claim 1, wherein the user device is at least one of a smartphone, an RFID device, and a Bluetooth enabled device.

10. A method of operating an elevator system, wherein the elevator system includes an elevator car having a first elevator car door, an audio system controller, at least one first speaker positioned adjacent the first elevator car door, and at least one second speaker positioned in the elevator car opposite the first elevator car door, the method comprising:

detecting an opening of the first elevator car door at a landing of the elevator system;

detecting a user device of a passenger, wherein the user device indicates that the passenger is a sight impaired user; and generating an audio orientation output from at least one of the first speakers or second speakers, wherein the audio orientation output indicates the opening of the first elevator car door.

11. The method of claim 10, further comprising detecting a request made at a landing of the elevator system, wherein the audio orientation output is generated at the at least one second speaker and indicates that the first elevator car door is open.

12. The method of claim 10, further comprising detecting a request made at a car operating panel within the elevator car, wherein the audio orientation output is generated at the at least one first speaker and indicates that the first elevator car door is open.

13. The method of claim 10, the elevator car comprising a second elevator car door opposite the first elevator car door and the at least one second speaker is positioned adjacent the second elevator car door, the method further comprising detecting a request made at a landing of the elevator system, wherein the audio orientation output is generated at the at least one first speaker and indicates that the second elevator car door is open.

14. The method of claim 10, the elevator car comprising a second elevator car door opposite the first elevator car door and the at least one second speaker is positioned adjacent the second elevator car door, the method further comprising detecting a request made at a car operating panel within the elevator car, wherein the audio orientation output is generated at the at least one second speaker and indicates that the second elevator car door is open.

* * * * *